US007665503B2

(12) United States Patent
Liu

(10) Patent No.: US 7,665,503 B2
(45) Date of Patent: Feb. 23, 2010

(54) LADDER DRUM FOR VENETIAN BLIND

(75) Inventor: Wei Maggie Liu, Taipei (TW)

(73) Assignee: Creative Minds Int'l Limited, Taipei County (TW)

( * ) Notice: Subject to any disclaimer, the term of this patent is extended or adjusted under 35 U.S.C. 154(b) by 137 days.

(21) Appl. No.: 11/854,278

(22) Filed: Sep. 12, 2007

(65) Prior Publication Data

US 2009/0065155 A1 Mar. 12, 2009

(51) Int. Cl.
*E06B 9/303* (2006.01)

(52) U.S. Cl. ..... 160/176.1 R; 160/177 R; 160/178.1 R; 24/132 R

(58) Field of Classification Search ..... 160/176.1 R, 160/177 R, 178.1 R, 173 R, 168.1 R; 24/132 R
See application file for complete search history.

(56) References Cited

U.S. PATENT DOCUMENTS 3,189,082 A * 6/1965 Hennequin ..... 160/178.1 R
4,821,789 A * 4/1989 Van Rens ..... 160/176.1 R
5,267,598 A * 12/1993 Marocco ..... 160/177 R
6,095,228 A * 8/2000 Liu ..... 160/173 R
6,745,812 B1 * 6/2004 Liu et al. ..... 160/177 R
6,976,522 B2 * 12/2005 Strand ..... 160/176.1 R
7,198,089 B2 * 4/2007 Hsu ..... 160/170
7,249,397 B2 * 7/2007 Abels et al. ..... 24/132 R
7,258,297 B2 * 8/2007 Liu ..... 242/398
7,493,932 B2 * 2/2009 Cheng ..... 160/173 R
2002/0110778 A1 * 8/2002 Abels et al. ..... 433/11

* cited by examiner

*Primary Examiner*—Katherine W Mitchell
*Assistant Examiner*—Philip S Kwon
(74) *Attorney, Agent, or Firm*—Rabin & Berdo, PC

(57) ABSTRACT

A ladder drum is mounted in a head rail of a Venetian blind for securing a ladder cord thereto, and includes a drum body installed on a tilt bar of the blind. An upper portion of the drum body is formed into an open-topped recess, which has two sidewalls interconnected by an end wall. A holder set is provided in the recess, such that a clearance is existed between the holder set and each of the sidewalls and a limiting space between the holder set and the end wall for receiving a securing element therein. The securing element is a rectangular frame has a rear end turnably received in the limiting space and a front end releasably engaged with a front side of the holder set to thereby firmly press two free ends of the ladder cord in the drum body against the two sidewalls of the recess.

9 Claims, 10 Drawing Sheets

LADDER DRUM FOR VENETIAN BLIND

FIELD OF THE INVENTION

The present invention relates to a ladder drum for a Venetian blind, and more particularly to a ladder drum that is mounted in a head rail of a Venetian blind to allow quick and adjustable securing of a ladder cord thereto at reduced time and labor.

BACKGROUND OF THE INVENTION

A blind is mounted to or near a window. Slats of the blind stop sun light from directly projecting through the window into a room, and shield an interior of the room from external environment. Please refer to FIGS. 1 and 2. For the slats of a conventional Venetian blind to tilt by an angle to close the window, a ladder drum A1 is mounted to and in each end of a head rail of the blind, and a ladder cord B1 having the slats held thereto is secured to the ladder drum A1. The ladder drum A1 is associated with a tilt bar C1 in the head rail and can therefore be turned by a desired angle along with the tilt bar under control. When the ladder drum A1 is turned by an angle, slats held to the ladder cord B1 secured to the ladder drum A1 are brought to synchronously tilt by the same angle.

The ladder drum A1 has an axial central shaft A2, and is provided on a top with two securing holes A3. Each of the two securing holes A3 has an expanded end and a reduced end communicable via a narrowed neck portion. To secure the ladder cord B1 to the ladder drum A1, first the two retaining blocks B2 are connected to two free ends of the ladder cord B1. A total of four retaining blocks B2 are needed because there are two ladder cords B1 provided for one Venetian blind. Then, the free ends of the ladder cord B1, which has the slats held thereto, are lead into the reduced ends of the two securing holes A3 via the expanded ends and the neck portion thereof. With the retaining blocks B2 being stopped by and held in the reduced ends of the securing holes A3, the free ends of the ladder cord B1 are secured to the ladder drum A1. When the tilt bar C1 is controlled to turn about an axis thereof, the ladder drum A1 and accordingly, the slats held thereto are brought by the tilt bar C1 to turn a certain angle at the same time.

In the above-described conventional ladder drum A1 for controlling the tilting angle of the slats of a Venetian blind, the retaining blocks B2 are used as stoppers to stop the ladder cord B1 from separating from the ladder drum A1. Generally, the retaining blocks B2 are manually or mechanically connected to the free ends of the ladder cord B1 and then extended through the securing holes A3 to be held to the reduced ends of the securing holes A3. In the event a retaining block B2 is connected to an incorrect position on the ladder cord B1, it must be removed from the ladder cord B1 and be reconnected to thereby increase the labor and time for assembling the ladder cord B1 to the ladder drum A1. The assembling efficiency is therefore lowered.

Moreover, the Venetian blind delivered from the blind manufacturer might be defective due to incorrectly connected retaining blocks B2 on the ladder cord B1. Such defect might not be found until the whole Venetian blind is mounted to a window and it is found the slats thereof are not in a horizontal position. Since some of the parts for mounting the Venetian blind are not reusable once they are dismounted from the blind, the worker has to troublesomely mount another new set of Venetian blinds to replace the defective one.

SUMMARY OF THE INVENTION

A primary object of the present invention is to provide a ladder drum for Venetian blind that enables quick assembling of a ladder cord to the ladder drum at reduced time and labor costs.

Another object of the present invention is to provide a ladder drum for Venetian blind that enables adjustable assembling of a ladder cord to the ladder drum to reduce the bad yield in the production of a Venetian blind and save the time and labor for reassembling the ladder cord to the ladder drum.

A further object of the present invention is to provide a ladder drum for Venetian blind that could be easily repaired and maintained to enable quick production and installation of the Venetian blind.

To achieve the above objects, the ladder drum for Venetian blind according to the present invention is mounted in a head rail of a Venetian blind for securing a ladder cord or a tape ladder thereto, and includes a drum body having a central shaft axially extended therethrough for associating with a tilt bar in the head rail of the Venetian blind, and a securing element.

The drum body has an upper portion formed into an open-topped recess having two sidewalls and an end wall interconnecting the two sidewalls. A holder set is provided in the recess close to a central area thereof, such that a clearance is existed between the holder set and each of the two sidewalls, and a limiting space is formed between a rear side of the holder set and the end wall of the recess.

The securing element has a second end being pivotally turnably received in the limiting space, and a first end opposite to the second end being releasably engaged with a front side of the holder set.

The two sidewalls of the recess are axially extended, parallelly spaced, and symmetrically shaped. The holder set is formed on the rear side facing the limiting space with a second transverse groove having a curved cross section. The limiting space is formed between the end wall of the recess and the second transverse groove, so that the second end of the securing element is received in the second transverse groove and may be pivotally turned to engage or disengage the first end of the securing element with or from a first transverse groove formed on the front side of the holder set.

In an embodiment of the present invention, the holder set includes a first and a second holder axially spaced from each other.

In an operable embodiment of the present invention, the central shaft has a hollow shaft hole. The shaft hole has a non-circular cross section, which may be a square, a hexagonal, or other suitable shapes, depending on actual need in design.

In an ideal embodiment of the present invention, the open-topped recess is internally provided on the two sidewalls near a middle area thereof with a vertical groove each, via which two free ends of the ladder cord are downward led into the recess to extend through and be held to two through holes separately formed on a bottom of the open-topped recess below lower ends of the two vertical grooves.

In an embodiment of the present invention, the securing element is a rectangular frame and has two stop lugs provided thereon to separately face toward the two vertical grooves when the securing element is engaged at the first and the second end with the front and the rear side of the holder set.

And, each of the two stop lugs has a beveled end surface for firmly pressing the free ends of the ladder cord against the vertical grooves.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
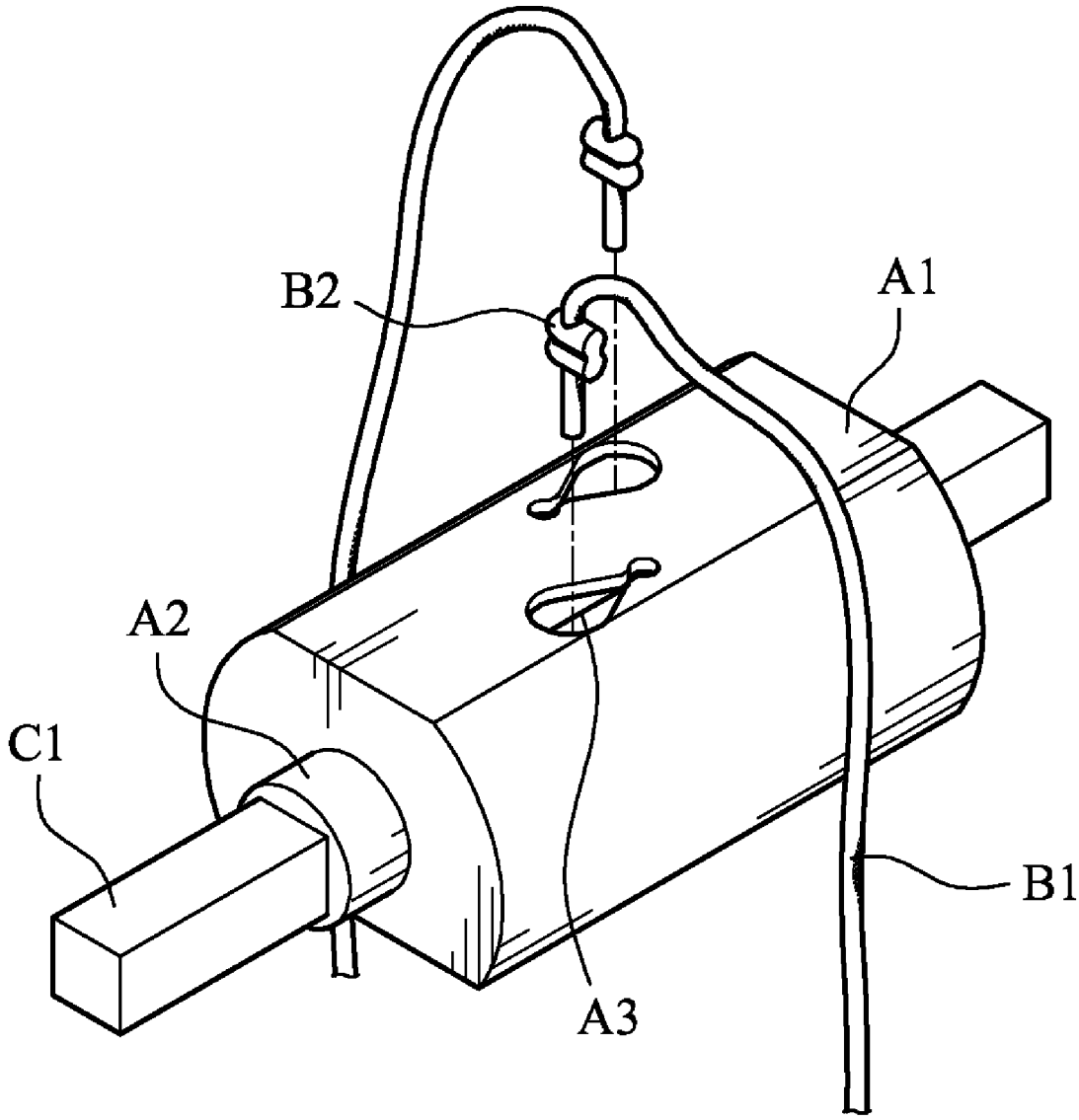
FIG. 1 (Prior Art)
FIG. 1 is a perspective view showing the securing of a ladder cord to a conventional ladder drum for a Venetian blind.
Figure 2:
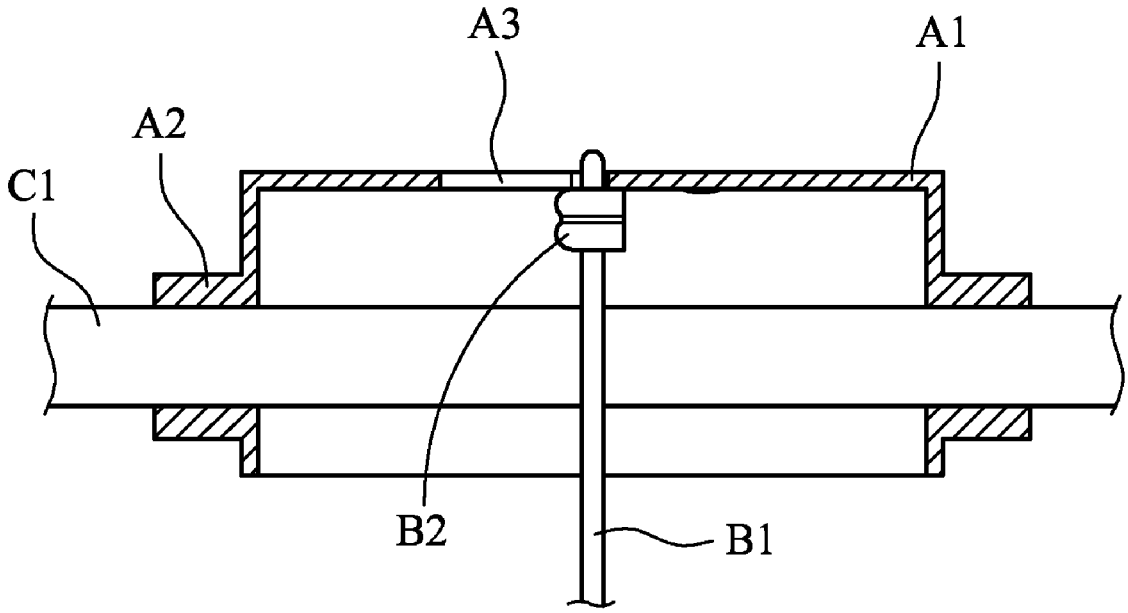
FIG. 2 (Prior Art)
FIG. 2 is a sectioned side view showing the conventional ladder drum of FIG. 1 with a ladder cord secured thereto.
Figure 3:
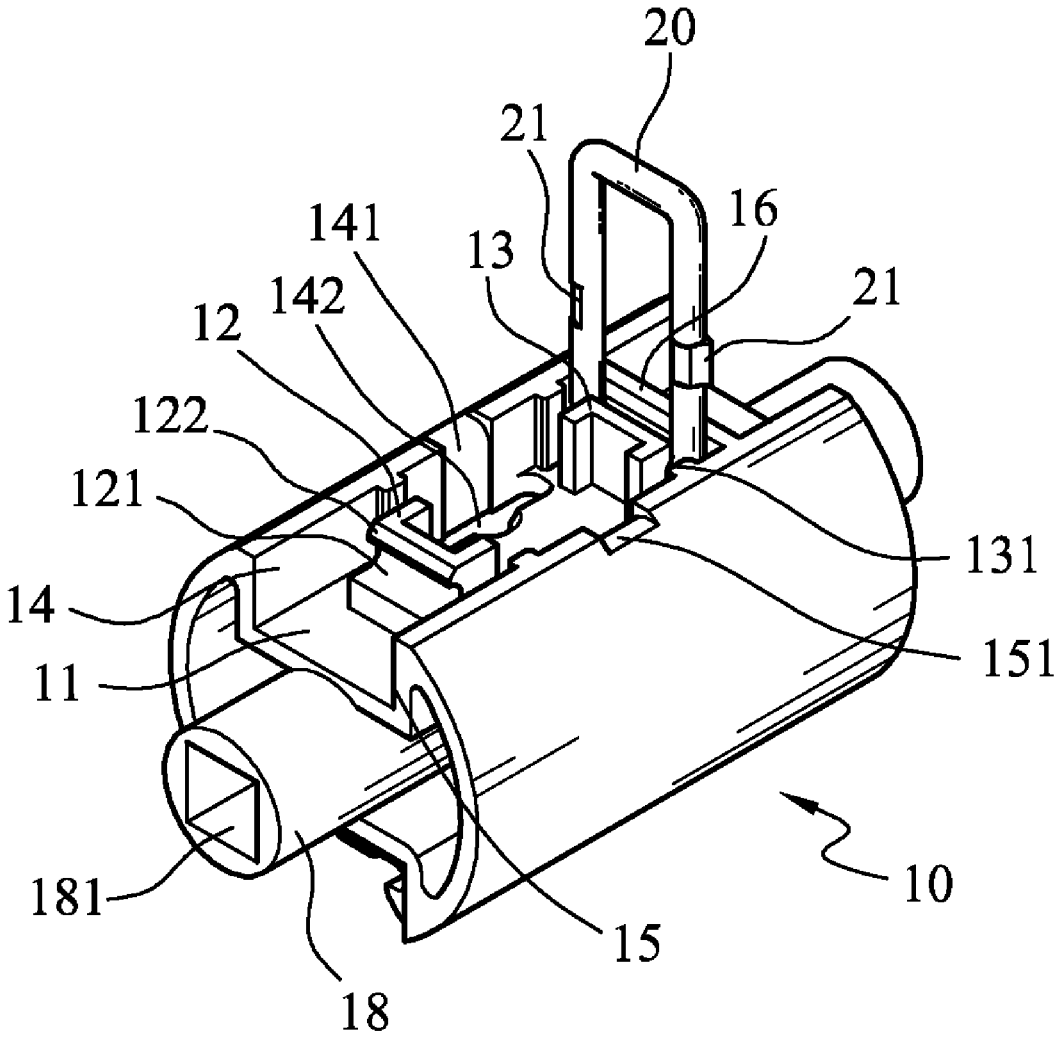
FIG. 3 is a perspective view of a ladder drum for Venetian blind according to the present invention.
Figure 4:
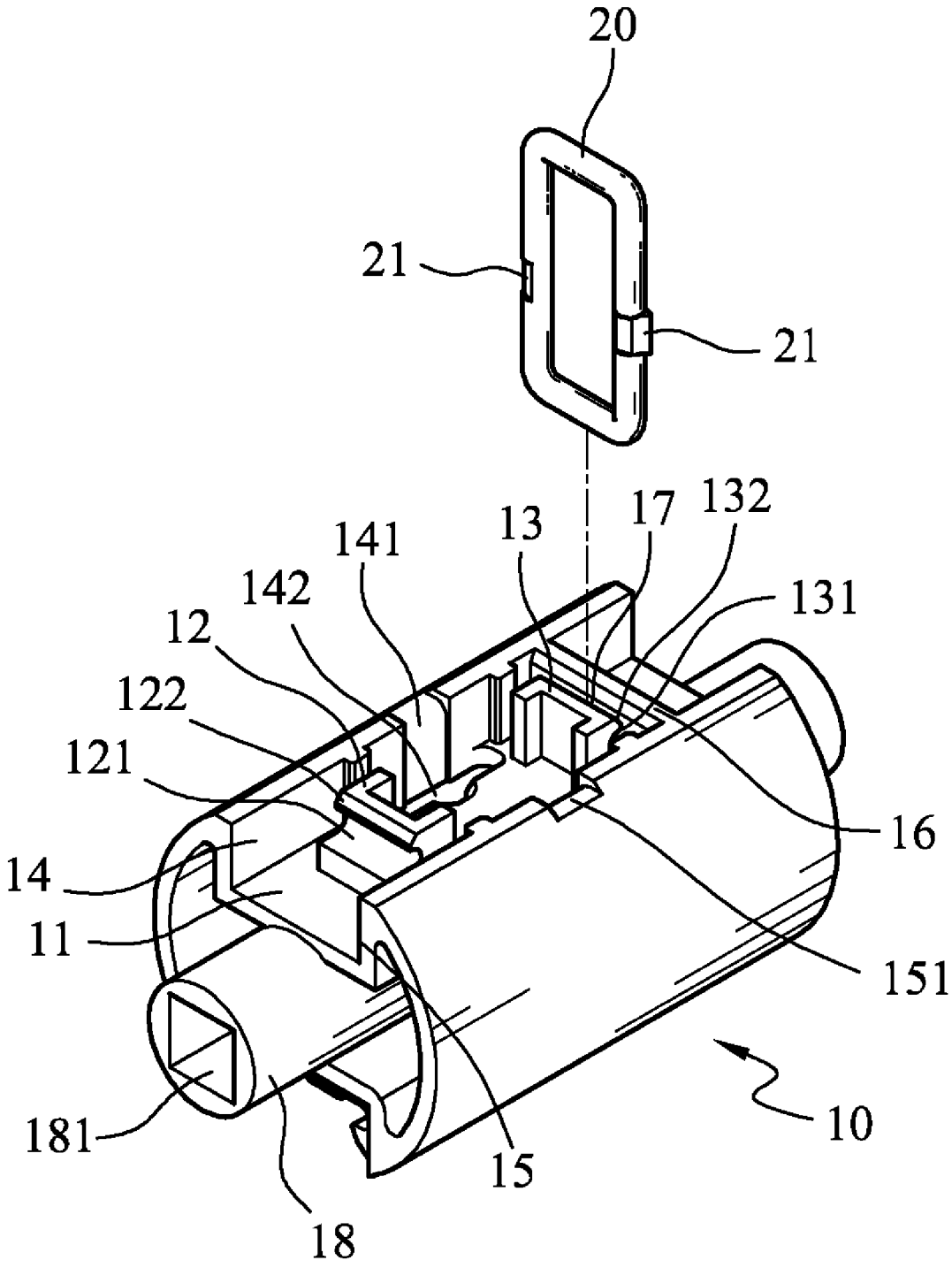
FIG. 4 is a partially exploded view of FIG. 3.
Figure 5:
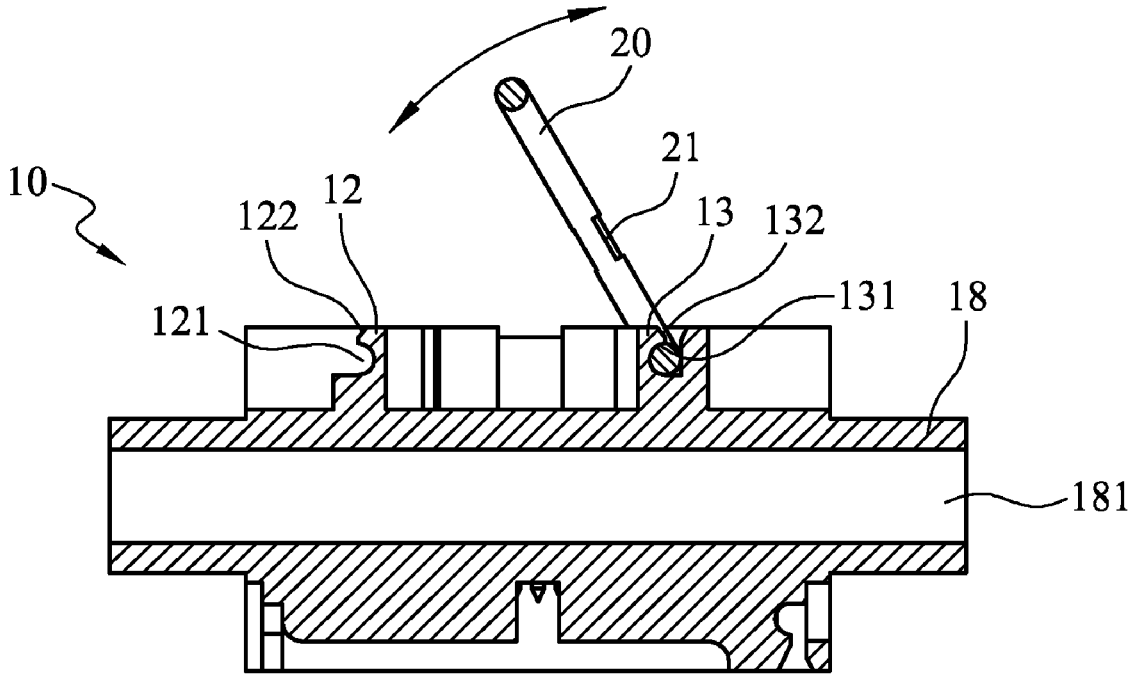
FIG. 5 is a sectioned side view of the ladder drum of the present invention showing the operation of a ladder cord securing element thereof.

Please refer to FIGS. 3 to 6, in which a ladder drum for a Venetian blind according to the present invention is shown. The ladder drum has a drum body 10, an upper portion of which is formed into an open-topped recess 11. In the recess 11, there are provided a first holder 12 and a second holder 13 axially spaced from each other. A limiting space 17 is formed between the second holder 13 and the end of the recess 11 for turnably holding a second end of a securing element 20 thereto. When the securing element 20 is pivotally turned about its second end in the limiting space 17, a first end of the securing element 20 opposite to the second end thereof may be moved toward the first holder 12 and held thereto.

The ladder drum of the present invention also includes a central shaft 18 axially extended through the drum body 10. The central shaft 18 defines a hollow shaft hole 181 having a non-circular cross section, which may be a square, a hexagonal, or other suitable shapes, depending on actual need in design.

In one embodiment of the present invention, the open-topped recess 11 includes two longitudinally extended, parallelly spaced, and symmetrically shaped sidewalls 14, 15. Both of the first and the second holder 12, 13 are spaced at two lateral ends from the two sidewalls 14, 15 by a predetermined clearance. The two sidewalls 14, 15 are provided near respective inner middle portions with a vertical groove 141, 151 each, via which two free ends of a ladder cord 30 may be conveniently led into the recess 11. The vertical grooves 141, 151 have a width slightly larger than a thickness of the ladder cord 30. With the vertical grooves 141, 151 provided on the sidewalls 14, 15, the drum body 10 is protected from being quickly worn and damaged due to friction between the ladder cord 30 and the sidewalls 14, 15 over a long time.

In an operable embodiment of the present invention, the recess 11 is provided near and behind the second holder 13 with an end wall 16 for interconnecting the two sidewalls 14, 15. The limiting space 17 is formed between the second holder 13 and the end wall 16. As can be clearly seen from FIG. 5, the second holder 13 is provided on a rear side facing the end wall 16 and adjacent to a bottom of the limiting space 17 with a second transverse groove 131. A second beveled surface 132 is formed on the second holder 13 at an upper edge of the tear side with the second transverse groove 131 formed thereon, so that the second end of the securing element 20 may be smoothly guided into the limiting space 17 via the second beveled surface 132 to locate it in the second transverse groove 131. The second beveled surface 132 and the end wall 16 together define a neck portion above the second transverse groove 131. The neck portion has a width slightly smaller than a thickness of the securing element 20.

In a preferred embodiment of the present invention, the securing element 20 is a rectangular metal frame being provided with two stop lugs 21, which are sideward projected from two lateral sections of the rectangular metal frame to separately face against the two vertical grooves 141, 151 when the securing element 20 is pivotally turned about the second end thereof relative to the second transverse groove 131 in the limiting space 17 to engage the first end with a first transverse groove 121 formed on one side of the first holder 12 facing away from the second holder 13. Each of the stop lugs 21 has one side formed into a beveled end surface, which would face downward when the securing element 20 is pivotally turned to engage the first end thereof with the first holder 12.

In a preferred embodiment of the present invention, a first beveled surface 122 is formed on the first holder 12 at an upper edge of the side with the first transverse groove 121, so that the first end of the securing element 20 may be smoothly guided into the first transverse groove 121 via the first beveled surface 122. Moreover, the first and second transverse grooves 121, 131 have a curved cross section corresponding to that of the first and second ends of the securing element 20.

Figure 6:
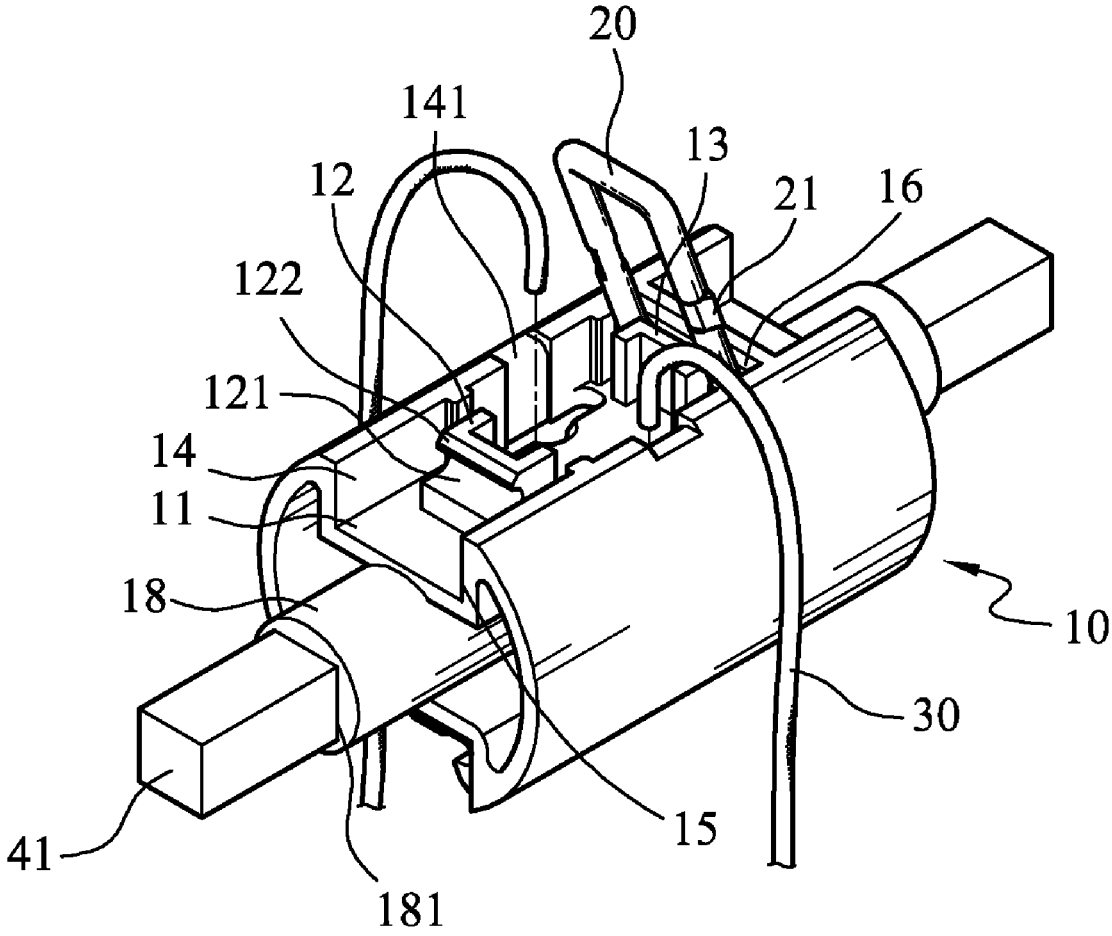
FIG. 6 is a perspective view showing the manner of connecting a ladder cord to the ladder drum of the present invention.
Figure 7:
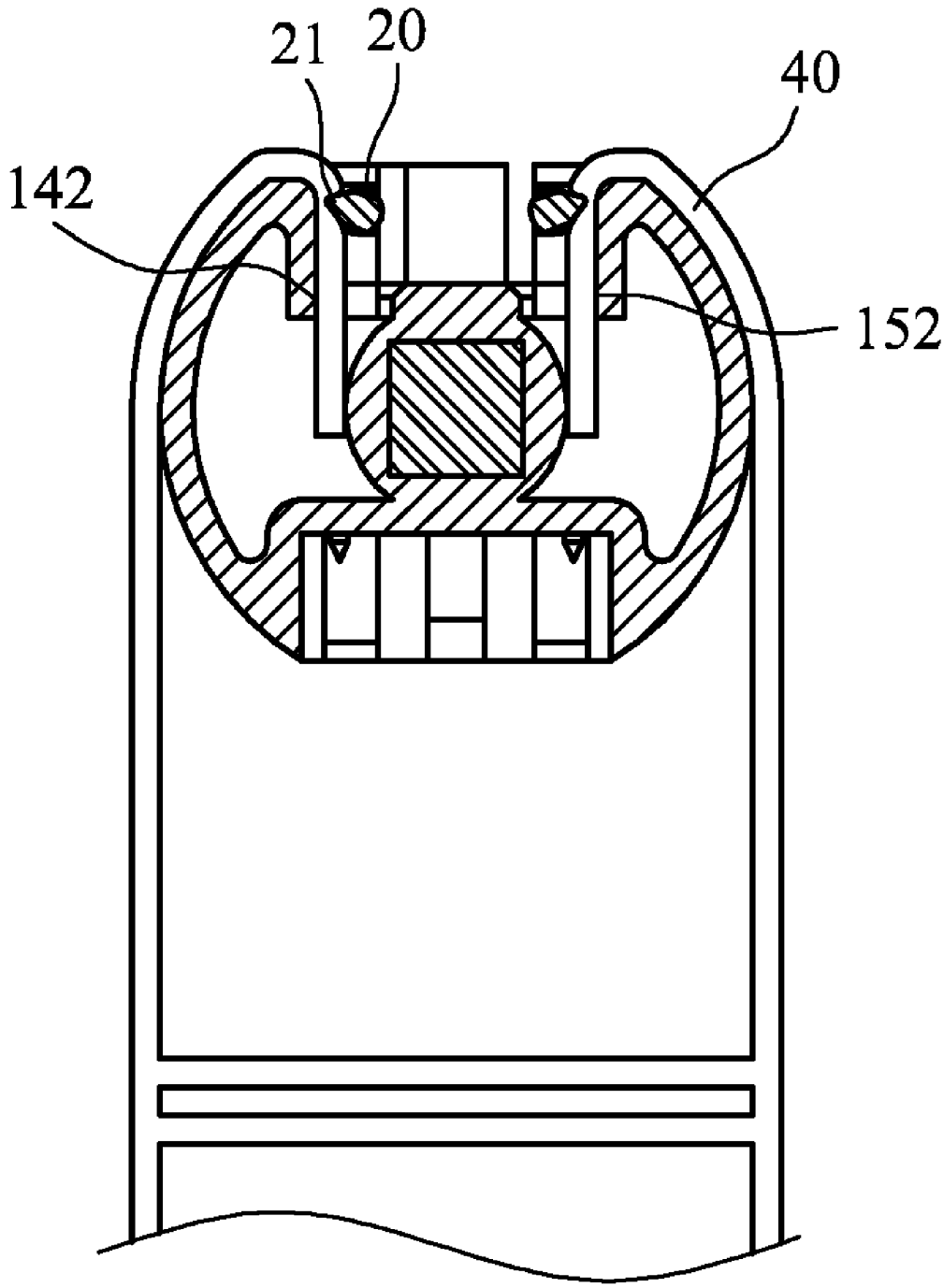
FIG. 7 is a cross sectional view showing the ladder drum of the present invention with a ladder cord secured thereto.

Please refer to FIGS. 6 and 7 at the same time. To enable two free ends of the ladder cord 30 to be conveniently and correctly assembled to the drum body 10, two through holes 142, 152 are separately provided on a bottom of the open-topped recess 11 below lower ends of the two vertical grooves 141, 151, so that the free ends of the ladder cord 30 may be separately guided by the two vertical grooves 141, 151 to bend downward and extend through the two through holes 142, 152.

Figure 8:
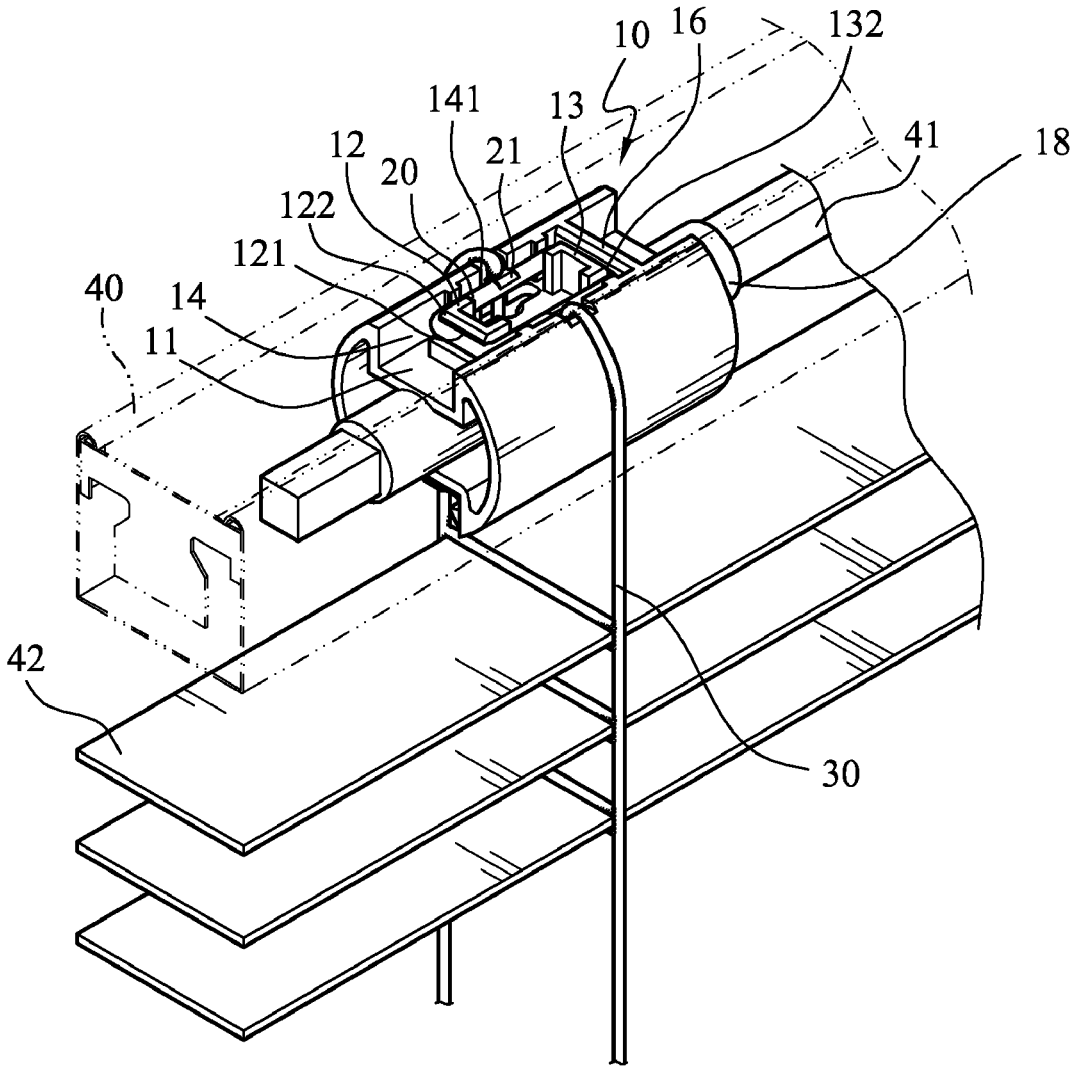
FIG. 8 is a partially phantom perspective view showing the mounting of the ladder drum of the present invention in a head rail of a Venetian blind.

As can be seen from a preferred embodiment of the present invention shown in FIG. 8, the drum body 10 is mounted in a head rail 40 of a Venetian blind by extending a tilt bar 41 of the blind in the head rail 40 through the shaft hole 181 of the central shaft 18 on the drum body 10, such that the whole drum body 10 may be turned by a desired angle about an axis of the tilt bar 41 when the tilt bar 41 is turned under control. At this point, a plurality of slats 42 of the Venetian blind held to the ladder cord 30 are brought by the turned drum body 10 to synchronously tilt by the same angle, as shown in FIGS. 9 and 10.

Please refer to FIGS. 6, 7, and 8. To assemble the ladder cord 30 having the slats 42 held thereto to the drum body 10, first the two free ends of the ladder cord 30 are lead through the two vertical grooves 141, 151 on the sidewalls 14, 15 of the drum body 10, so that the two free ends are located at the same level in the recess 11 and extended down through the two through holes 142, 152. Then, the securing element 20 is pivotally turned about the second end to engage the first end with the first transverse groove 121 on the first holder 12 via the first beveled surface 122. At this point, the beveled end surfaces of the two stop lugs 21 at two lateral sections of the securing element 20 are brought to firmly press the two free ends of the ladder cord 30 against the two vertical grooves 141, 151, so that the whole ladder cord 30 is secured to the drum body 10 without the risk of easily separating from the ladder drum.

Figure 9:
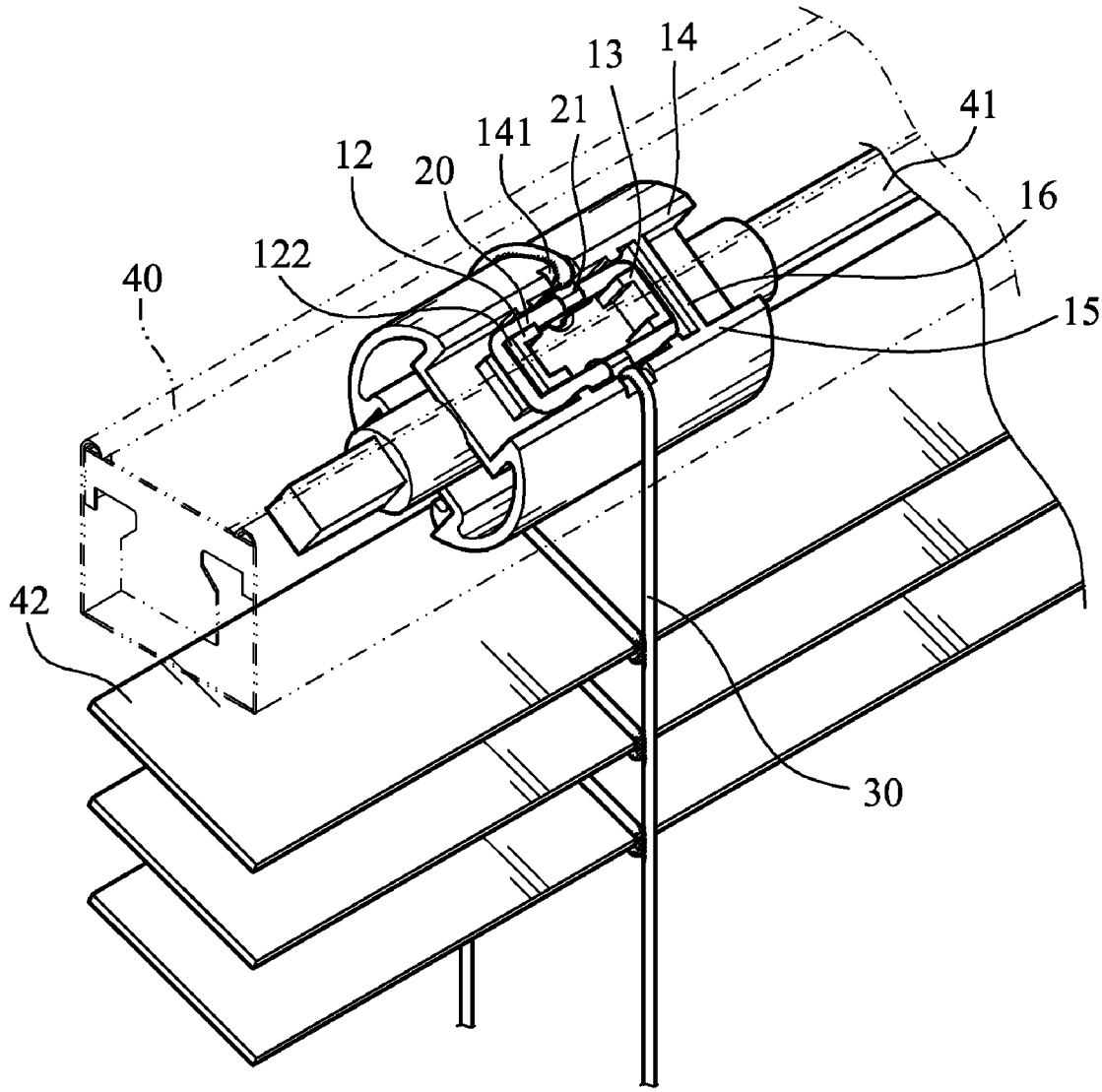
FIG. 9 shows the ladder drum of FIG. 8 is turned by an angle to tilt the slats of the Venetian blind.
Figure 10:
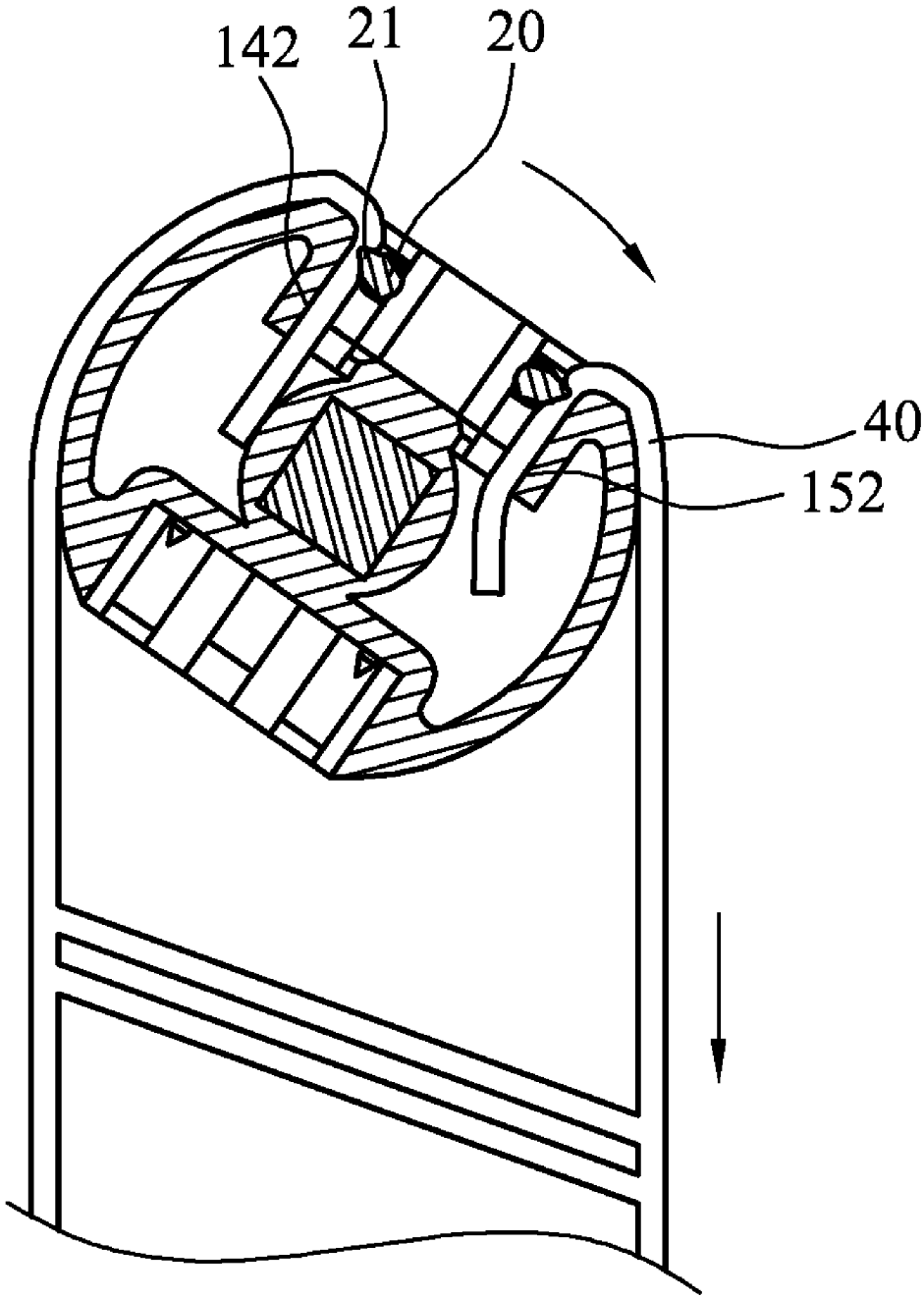
FIG. 10 is a cross sectional view of the turned ladder drum of FIG. 9.

Please refer to FIGS. 9 and 10. With the securing element 20 located in a position with the first and second ends thereof engaged with the first and second transverse grooves 121, 131 on the first and the second holder 12, 13, respectively, and the two free ends of the ladder cord 30 being firmly pressed by the two stop lugs 21 of the securing element 20 against the two vertical grooves 141, 151 without the risk of separating from the drum body 10, the whole ladder drum of the present invention may be easily turned via the tilt bar 41 to thereby adjust the slats 42 to a desired tilt angle.

With the securing element 20 and the second holder 13 provided on the drum body 10, the ladder cord 30 may be more easily assembled to the drum body 10 with reduced errors in installation. Therefore, the time and labor needed to assemble and/or reassemble the ladder cord 30 to the ladder drum are largely reduced to improve the efficiency in installing the whole Venetian blind.

The ladder drum for Venetian blind according to the present invention has a simple structure and could be easily maintained or repaired. When a Venetian blind mounted to a window is found in a non-horizontal position, a worker needs only to disengage the securing element 20 from the first transverse groove 121 on the first holder 12 and readjust the ladder cord 30 to a correct level, and push the securing element 20 to engage with the first holder 12 again.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A ladder drum for mounting in a head rail of a Venetian blind to secure a ladder cord or a tape ladder thereto, comprising:

a drum body having a central shaft axially extended therethrough, the drum body having an upper portion formed into an open-topped recess having two sidewalls and an end wall interconnecting the two sidewalls;

a holder set provided in the recess close to a central area thereof, such that a clearance is formed between the holder set and each of the two sidewalls, and a limiting space is formed between a rear side of the holder set and the end wall of the recess; and a rectangular, frame-shaped securing element having a first end, a second end pivotally turnably received in the limiting space, and two lateral sides, each lateral side interconnecting the first end to the second end, the first end being opposite to the second end and being releasably engaged with a front side of the holder set, each lateral side being disposed alongside a respective sidewall when the first end is engaged with the front side of the holder set and thereby clamps the ladder cord or tape ladder between a respective lateral side and a respective sidewall.

2. The ladder drum for Venetian blind as claimed in claim 1, wherein the holder set includes a first holder and a second holder longitudinally spaced from each other, and the limiting space being formed between a rear side of the second holder and the end wall of the recess.

3. The ladder drum for Venetian blind as claimed in claim 1, wherein the holder set is provided on its rear side and adjacent to a bottom of the limiting space, with a second transverse groove, in which the second end of the securing element is received.

4. The ladder drum for Venetian blind as claimed in claim 2, wherein a rear side of the second holder, adjacent to a bottom of the limiting space, is provided with a second transverse groove, in which the second end of the securing element is received.

5. The ladder drum for Venetian blind as claimed in claim 1, wherein a first side of the holder set is provided with a first transverse groove for releasably engaging with the first end of the securing element.

6. The ladder drum for Venetian blind as claimed in claim 1, wherein a middle area of the two sidewalls are each provided with a vertical groove, a bottom of the recess below lower ends of the two vertical grooves being provided with two through holes, the ladder cord or the tape ladder having two respective free ends that are downward led into the recess via the two vertical grooves to downward extend through the two through holes; and wherein the securing element is a rectangular frame, and has two stop lugs provided thereon to separately face toward the two vertical grooves when the second end of the securing element is received in the limiting space and the first end of the securing element is engaged with the front side of the holder set; and each of the two stop lugs having a beveled end surface for firmly pressing the free ends of the ladder cord or the tape ladder against the vertical grooves.

7. The ladder drum for Venetian blind as claimed in claim 1, wherein the central shaft on the drum body defines an axial hollow shaft hole for receiving a tilt bar of the Venetian blind therein.

8. The ladder drum for Venetian blind as claimed in claim 7, wherein the shaft hole has a cross section in a non-circular geometrical shape.

9. A ladder drum for mounting in a head rail of a Venetian blind to secure a ladder cord or a tape ladder thereto, comprising:

a drum body having a central shaft axially extended therethrough, the drum body having an upper portion formed into an open-topped recess having two sidewalls and an end wall interconnecting the two sidewalls;

a holder set provided in the recess close to a central area thereof, such that a clearance is formed between the holder set and each of the two sidewalls, and a limiting space is formed between a rear side of the holder set and the end wall of the recess; and a securing element having a first end, and a second end pivotally turnably received in the limiting space, the first end being opposite to the second end and being releasably engaged with a front side of the holder set;

wherein a middle area of the two sidewalls are each provided with a vertical groove, a bottom of the recess below lower ends of the two vertical grooves being provided with two through holes, the ladder cord or the tape ladder having two respective free ends that are downward led into the recess via the two vertical grooves to downward extend through the two through holes;

wherein the securing element is a rectangular frame, and has two stop lugs provided thereon to separately face toward the two vertical grooves when the second end of the securing element is received in the limiting space and the first end of the securing element is engaged with the front side of the holder set; and wherein each of the two stop lugs has a beveled end surface for firmly pressing the free ends of the ladder cord or the tape ladder against the vertical grooves.

* * * * *